United States Patent [19]

Bengtsson

[11] 4,156,448

[45] May 29, 1979

[54] JALOUSIE DOOR

[76] Inventor: Fred B. Bengtsson, Kyrkås trappor 3, Partille, Sweden, 43300

[21] Appl. No.: 826,754

[22] Filed: Aug. 22, 1977

[30] Foreign Application Priority Data

Dec. 29, 1976 [SE] Sweden ..... 7614659

[51] Int. Cl.[2] ..... E06B 3/12; E06B 9/00

[52] U.S. Cl. ..... 160/232; 160/201

[58] Field of Search ..... 160/232, 229, 201, 209

[56] References Cited

U.S. PATENT DOCUMENTS

| | | | |
|---|---|---|---|
| 2,494,001 | 1/1950 | Rowe | 160/229 R |
| 2,880,796 | 4/1959 | Stroup | 160/232 |
| 3,941,180 | 3/1976 | Thill | 160/232 X |
| 3,967,671 | 7/1976 | Stanley et al. | 160/232 |
| 3,980,123 | 9/1976 | Vago | 160/201 |

FOREIGN PATENT DOCUMENTS

| | | | |
|---|---|---|---|
| 732799 | 4/1966 | Canada | 160/232 |

*Primary Examiner*—Philip C. Kannan

[57] ABSTRACT

A jalousie door as described, having sections turnable about horizontal axes, the door being formed by a plurality of upper and lower juxtapositioned sections, each provided with an upper edge portion of a stepwise increasing height extending from the outside to the inside of the door, the side of the step facing outwardly forming a chute shaped cavity which is open outwardly and extending along the respected sections, the upper wall forming the cavity being horizontal when in a closed position.

7 Claims, 3 Drawing Figures

JALOUSIE DOOR

The present invention relates to a device in connection with jalousie doors, i.e. comprising sections in between them pivotable round horizontal links.

Doors of the kind mentioned of the prior art have often presented a problem, especially when raindrops with great force strike against the door resulting in the slits between the sections arranged one above the other permitting accumulated water to flow down on the inside of the door, when it is opened.

It is an object of the present invention in the first place to eliminate this drawback and provide a door, which can be opened without risk for the person opening the same that water accumulated in the junctions of the sections will come down on top of him. This object is reached by means of the device according to the invention, which substantially is characterized by the lower one of two juxtapositioned sections exhibiting an upper edge portion with a stepwise increasing height as counted from the outside of the door in question, the side of the step facing in outwards direction being shaped with a chuteshaped cavity extending along the link and being open towards the outside.

Figure 1:
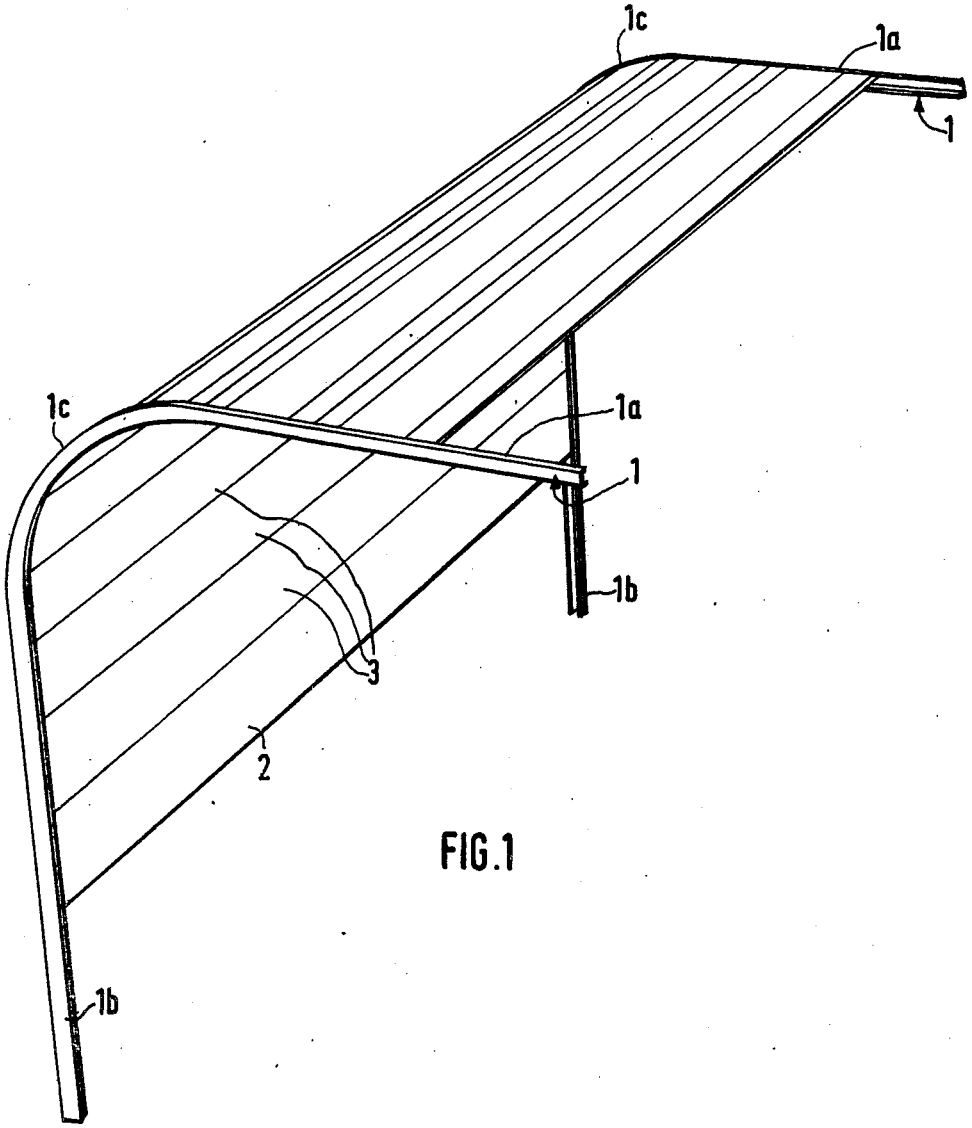
Figure 2:
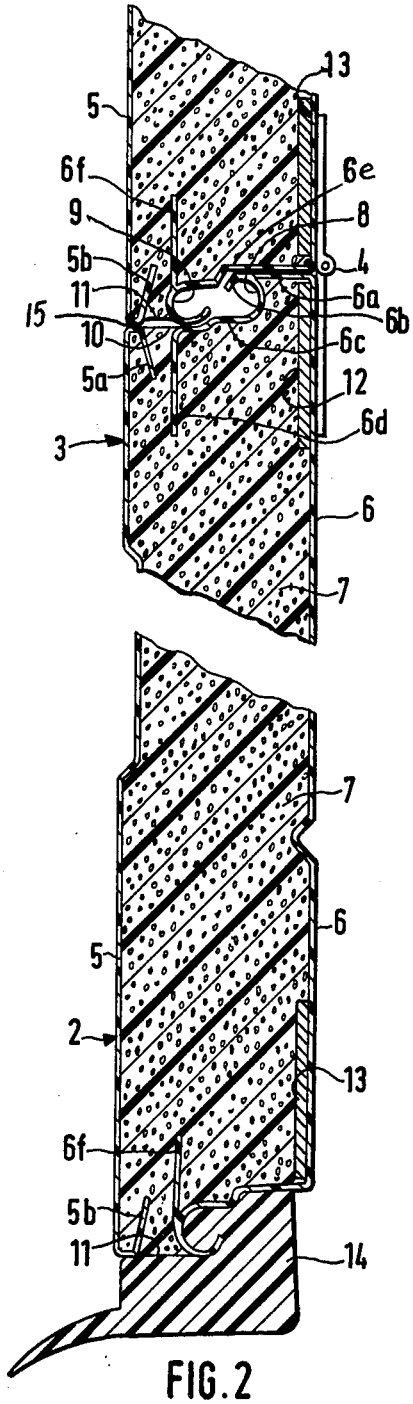
Figure 3:
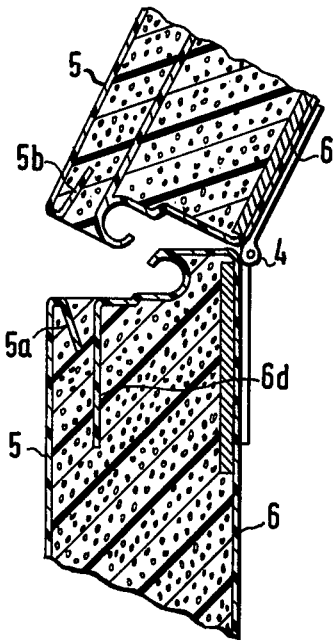

In the following an example of a door designed with the device according to the invention will be described, reference being made to the accompanying drawings, in which;

FIG. 1 is a view of a door designed with the device according to the invention seen in a top view at an oblique angle and from the inside in partly opened up condition of the door, FIG. 2 is a vertical cross-sectional view illustrating for one thing a link portion between two sections located one above the other and for another thing the bottom edge portion of the bottom section of the door in closed condition of the door, and FIG. 3 is a corresponding cross-sectional view through the link portion at the transition between the vertical and horizontal portions of the guide rail of the door.

In FIG. 1 for clarity's sake only such details have been included as have a direct connection with the present invention. Thus, in this drawing only two guide rails 1, each one at its lateral edge of the door, have been included, which guide rails for one thing exhibit a horizontal top portion 1*a* and for another thing a vertical portion 1*b*, which blend into one another via an intermediate portion 1*c* bent in a curve. The door comprises a number of sections 2 and 3 located one above the other, which in between them are hinged round horizontally extending links 4. Such doors are further equipped with an elevator machinery not shown in the drawings.

In the illustrated embodiment the door comprises a number of sections, which are identical as to shape. Therefore only the bottom edge portion of the bottom section 2 of the door is illustrated in vertical cross section as well as the two juxtapositioned edge portions of the door sections 3 located above the same. Each one of the door sections comprises a shell divided up in two portions, the outer portion 5 of said shell forming the outside of the door and the inner portion 6 thereof forming its inside. Between the two shell halves the door contains a layer 7 of heat insulating material, by way of example plastic polyethylene foam. The upper edge portion of each one of the door sections 2 and 3 from the outside of the door, i.e. from the left according to the drawings, exhibits a stepwise increasing height, the side turned in outwards direction of the step exhibiting a chutelike cavity 8, which is open towards the outside and extends along the link 4. As in also evident from the FIGS. 2 and 3 the lower edge portions of the door sections also exhibit a corresponding stepshape complementary to the upper edge portions. Also the lower edge portion exhibits a horizontal cavity 9. The inner shell half 6 blends upwards into a horizontal edge portion 6*a*, which approximately at the center of the section is shaped with a downwards bent drop edge 6*b*, which forms the upper opening edge of the chute-like cavity 8, of which the portions 6*a* and 6*b* shape its upper wall. The lower wall 6*c* of the cavity 8 sloping in direction towards the outside of the door blends into a flange portion 6*d* inwards bent into the filling 7 of the section. The outer shell half 5 likewise blends into a flange 5*a* inwards bent into the filling 7 of plastic foam, said flange 5*a* being located at a certain distance from the flange portion 6*d*. This distance is bridged by the filling of foam material and a membrane 10 of some material of low heat conductivity. In a corresponding manner the inner shell half 6 blends downwards into a lower edge portion 6*e*, which terminates with a flange portion 6*f* projecting upwards into the filling of plastic foam. Further the outer shell half 5 blends into a flange portion 5*b* projecting downwards into the filling of plastic foam. The distance between the two flange portions 6*f* and 5*b* is bridged by a membrane 11 of some material exhibiting a low conductivity of heat, by way of example a plastic material. By means of this design the otherwise so common cold-bridge is avoided. The link 4 forms a hinge, which is fastened to fastening plates 12 and 13 respectively, which in the casting operation are embedded on the inside of the shell halves 6. In the lower cavity 9 of the lower door section 2 a sealing ledge 14 is fastened, which is intended to co-operate with the lower portion of the door opening. It is further possible to mount a sealing ledge in the lower cavity 9 of the other door sections 3, which ledge in closed condition of the door abuts against the drop edge 6*b* from above. In a heavy shower of rain against the door water penetrates into the outer portion of the slit 15 between two door sections and is collected in the upper chute 8 of the sections. When the water is flowing in, an eddy is created in this chute, which prevents any further penetration of water also in the case there is no sealing ledge in the lower chute 9 of the sections. Water that has penetrated remains in the chute 8, when the door is opened, as the sections take a horizontal position without flowing further on through the slit 15 and from there drop down from the inside of the door, when the same is in lifted up position. When the door again is closed, the water instead flows back from the chute 8 escaping outwards on the outside of the door.

The invention is not limited to the embodiment described above and illustrated in the drawings by way of example only, but can be varied as to its details within the scope of the following claims without therefore departing from the fundamental idea of the invention.

I claim:

1. A jalousie door having sections turnable about horizontal axes, comprising a plurality of upper and lower juxtapositioned sections, each provided with an upper edge portion of a stepwise increasing height extending from the outside to the inside of the door, the side of the step facing outwardly forming a chuteshaped cavity which is open outwardly and extending along said sections respectively, the upper wall forming said cavity being substantially horizontal when in a closed position of the door.

2. A door according to claim 1, wherein said upper wall forming said cavity terminates in a downward direction.

3. A door according to claim 1 wherein the lower wall forming said cavity extends downwardly and outwardly.

4. A door according to claim 1 wherein the lower edge portion of each section has a stepwise decreasing height which is complementary to the upper edge of a corresponding lower section and forms a chuteshaped cavity which is open toward the inside of the door.

5. A door according to claim 4 wherein said sections form a sealing ledge between the upper and lower sections.

6. A door according to claim 1, wherein the sections comprise inner and outer sheet plate shells forming the surfaces of the door and enclosing a filling of heat insulating material, the edge surfaces of the sheet plate shells of the respective sections being bridged by said insulating material.

7. A door according to claim 6, wherein the edge surfaces of said sheet plate terminate in flanges bent inwardly and embedded in said heat insulating material.

* * * * *